United States Patent [19]

Dreier

[11] 4,315,474

[45] Feb. 16, 1982

[54] THREAD TAKE-OFF DEVICE OF A SEWING MACHINE

[75] Inventor: Ernst Dreier, Steckborn, Switzerland

[73] Assignee: Fritz Gerauf Aktiengesellschaft Bernina-Nahmaschinenfabrik, Steckborn, Switzerland

[21] Appl. No.: 147,164

[22] Filed: May 6, 1980

[30] Foreign Application Priority Data

May 23, 1979 [CH] Switzerland ..... 4831/79

[51] Int. Cl.[3] ..... D05B 49/00

[52] U.S. Cl. ..... 112/242

[58] Field of Search ..... 112/242, 241, 243, 248

[56] References Cited

U.S. PATENT DOCUMENTS

| | | | |
|---|---|---|---|
| 2,436,449 | 2/1948 | Pikul | 112/242 |
| 2,438,833 | 3/1948 | Wood | 112/242 |
| 2,883,954 | 4/1959 | Dreher | 112/242 |

FOREIGN PATENT DOCUMENTS

| | | | |
|---|---|---|---|
| 389374 | of 0000 | Switzerland | 112/242 |
| 273921 | 6/1951 | Switzerland | 112/242 |

*Primary Examiner*—H. Hampton Hunter

*Attorney, Agent, or Firm*—Birch, Stewart, Kolasch & Birch

[57] ABSTRACT

The thread take-off device of the sewing machine is arranged between the needle thread reservoir and the thread tightener. This device is provided to prevent the direct take-off of the thread by the take-up lever from the storage spool by providing, in front of the tightener, an appropriate thread reserve without requiring any change in the path along which the thread is traveling. The take-off device comprises a lever oscillating synchronously with the take-up lever at right angles to the thread path. A lever portion, located in the rest position of the take-off lever, approximately at right angles to the thread and directly beside the latter, intersects with each downward movement of the take-up lever control arm, the travel path of the thread, whereby a thread reserve is pulled off from the spool. The return of the take-off lever is effected by a spring. It is not necessary to thread the yarn into the take-off lever or into any other, additional thread guide elements added solely because of this take-off device. The device is particularly suitable for household sewing machines with installed thread tighteners.

8 Claims, 3 Drawing Figures

THREAD TAKE-OFF DEVICE OF A SEWING MACHINE

BACKGROUND AND SUMMARY OF THE INVENTION

The present invention relates to a thread take-off device of a sewing machine arranged in front of the thread tightener for pulling off a predetermined amount of thread from the needle thread reservoir.

Thread take-off devices of this type, which make available sufficient slack thread between the thread reservoir and the thread tightener to prevent, during stitch formation, a tensioning of the thread between the reservoir and the thread tightener are well known in the art, as shown for example, in Swiss Pat. No. 389,374. A disadvantage in these types of devices is that the operator must deliberately guide the needle thread through the thread take-off device during the threading of the machine. The thread must be deflected several times during this procedure and must be inserted in special guide means. Thus, the operation of the machine becomes complicated, and the thread is furthermore placed under a relatively great stress. Additionally, the conventional devices are relatively expensive and poorly suited for the installed thread tighteners.

Sewing machines are known wherein the needle thread is guided from the storage spool arranged at the top in the area of the back side of the machine to a deflecting eye, from where the thread travels through a transverse slot in the arm lid in the forward direction and via an installed thread tightener to the take-up lever at the front side of the machine. The insertion of the thread is especially simple in this type of construction.

To avoid the aforementioned disadvantages of the conventional arrangements, the thread take-off device of the present invention is characterized in that a take-off lever is provided in the area of the thread path leading to the thread tightener. The take-off lever oscillates at right angles to the thread path and in synchronism with the take-up lever and is operated, while intersecting the thread path, against a spring force produced by the control arm of the take-up lever.

In contrast to conventional arrangements, the thread take-off lever is thus associated with the existing thread path, and no additional guide operations and/or threading operations of any kind are required.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
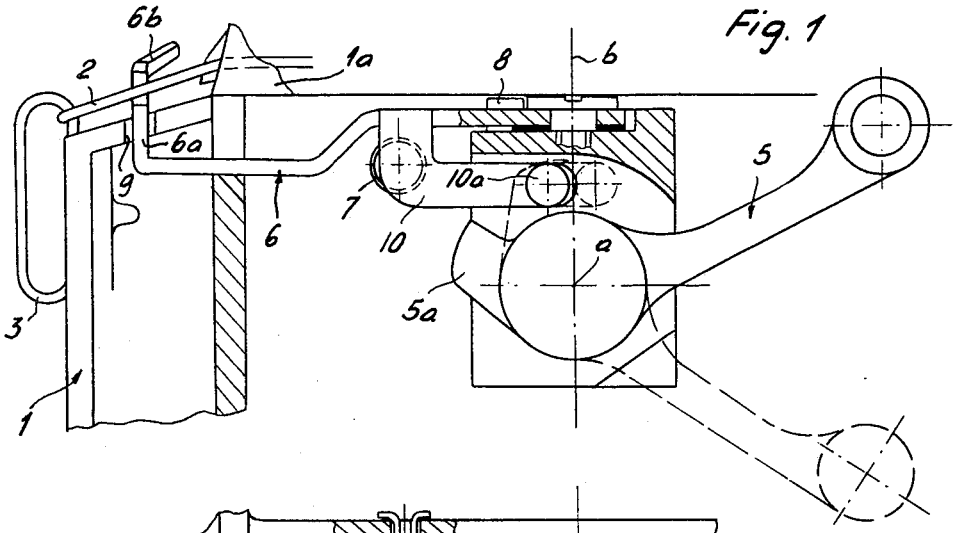
FIG. 1 shows the take-off device in a vertical cross-sectional view taken through the machine arm.

In the drawings, element 1 denotes the machine arm housing with a lid 1*a*. The storage spool for the needle thread 2, which is not shown in the drawings, is arranged as usual at the top in the area of the back side of the housing 1. The thread 2 is guided toward the front via a guiding eye 3 through a transverse slot 4 in the lid

Figure 2:
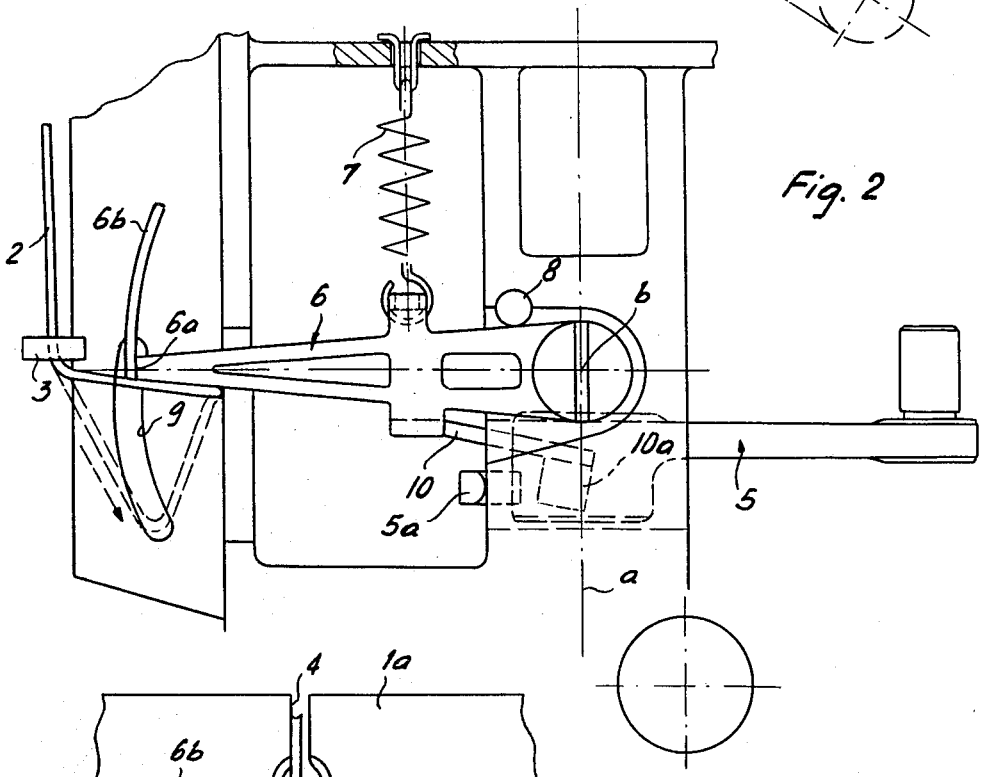
FIG. 2 is a top view of FIG. 1.
Figure 3:
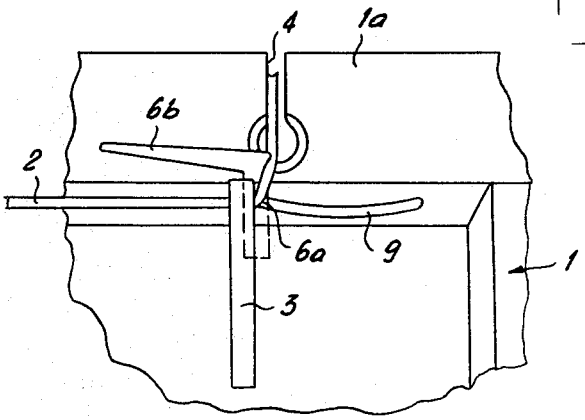
FIG. 3 is an elevational view from the left side of FIG. 1.

1*a* where it leads, via a thread tightener installed in the arm and not illustrated, to the customary take-up lever. The control arm 5 of the articulated take-up lever is fashioned as a double lever and is mounted in the housing 1 to be pivotable about a horizontal axis a. A take-off lever 6, pivotable about a vertical axis b is disposed below the traveling path of the thread, as determined by the eye 3 and the lid slot 4. The take-off lever is held in its rest position fixed by a stop 8 by means of a spring 7 (FIG. 2). The free end of the take-off lever 6 is angled in the upward direction, extending through an arcuate slot 9 in the housing. The vertical, upwardly projecting lever portion 6*a* terminates, in turn, in an approximately horizontal, angled guide tongue 6*b* conforming approximately to the arcuate slot 9. As can be seen from FIGS. 2 and 3, the lever portion 6*a*, in the rest position of the take-off lever 6, contacts practically directly the thread section lying between the eye 3 and the lid slot 4 on the thread side facing the spring 7. A permanently bent dog (entrainment means) 10 projects from the central portion of the take-off lever 6 on the side facing away from the spring 7 and is oriented toward the bearing side of the lever. A lateral end pin 10*a* of the dog 10 projects into the traveling path of the cam-shaped arm 5*a* of the control arm 5 in such a way that, during the downward pivoting of the thread lever, the correspondingly upwardly pivoting of the cam-shaped portion of the control arm 5*a* abuts against the pin 10*a* and thereby pivots the take-off lever 6 in the direction of arrow c. Thus, each downward pivoting of the take-up lever results in a corresponding, horizontal oscillating movement of the take-off lever 6 against the bias of the spring 7, the lever portion 6*a* intersecting the thread path and positively entraining the thread during this step. Thus, the take-off lever portion pulls off a corresponding amount of thread from the reservoir, as indicated by the dashed lines in FIG. 2. Thanks to the bias of the spring 7, the take-off lever 6, after being released by the control arm 52, swings back positively into a rest position. The lever relationships are selected so that the take-off lever 6 with a swinging motion of about 15°, makes a sufficiently large thread reserve available to avoid, even in extreme cases, a direct take-off of the thread by the take-up lever from the thread reservoir.

The essential factor here is that the threading of the thread 2 can take place without considering the take-off device. The guide tongue 6*b* of the take-off lever prevents the thread from positioning itself, for example, behind the lever portion 6*a* in case the thread is inserted somewhat inaccurately in the guide means in the lid slot 4. Due to the slightly inclined course of this guide tongue 6*b*, the thread placed thereon will automatically slide to the front of the lever portion 6*a*. An erroneous threading is thus made practically impossible. However, threading could also take place if the take-off lever 6 is not in its rest position. In such a case the thread would indeed first come to lie on the guide tongue 6*b*, but it would automatically slide off the guide tongue into the correct threading position as soon as the take-off lever swings back into its rest position.

It should be understood that, because of the herein described configuration, arrangement, and movement pattern of the take-off lever 6, it could be associated with the traveling path of a number of machines to form a thread reserve, without having to alter the thread path or the engaging elements establishing the thread path, or without having to provide additional elements of this type.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. In a sewing machine apparatus containing a needle thread reservoir, a thread tightener and a take-up lever, the improvement which comprises a thread take-off device disposed in the zone of the thread path between the needle thread reservoir and the thread tightener for taking off a slack amount of thread reserve from the needle thread reservoir, said thread take-off device being operatively connected to a spring bias means for maintaining said take-off device in said thread path, said take-off device being pivotally mounted for movement against said bias, substantially perpendicularly to the thread path, and said take-up lever being rotatably mounted to the sewing machine and adapted to engage said thread take-off device so that by the operation of the take-up lever, said take-up lever engages said take-off device, causing said take-off device to intersect the thread path against the bias of the spring bias means.

2. The apparatus of claim 1, wherein the thread take-off device is mounted to rotate in substantially the horizontal plane and the take-up lever is mounted to rotate in substantially the vertical plane.

3. The apparatus of claims 1 or 2, wherein the take-up lever contains a control arm which further contains a cam-shaped arm and the take-off device is provided with a laterally extending dog, said cam-shaped arm being adapted to engage said laterally extending dog through the actuation of the take-up lever.

4. The apparatus of claims 1 or 2, wherein a stop means is adapted to engage the thread take-off device for holding it in the zone of the thread path against said spring bias.

5. The apparatus of claim 2, wherein the thread take-off device includes a take-off arm which extends substantially perpendicular to the plane of rotation of the thread take-off device.

6. The apparatus of claim 5, wherein the arm of the thread take-off device is provided with a guide tongue which extends substantially perpendicular to said arm in a direction away from the travel path of the thread, said guide tongue preventing an undesirable extending of the thread behind the take-off device during the threading of the needle thread.

7. The apparatus of claim 6 wherein the guide tongue is canted slightly in the direction of the thread path.

8. The apparatus of claim 6, wherein the sewing machine is provided with a housing which contains a guide eye means and a transverse slot which extends along said housing for establishing said thread path, said arm of the thread take-off device extending upwardly through an arcuate slot provided in the housing between the guide eye and the transverse slot and past the traveling path of the thread.

* * * * *

UNITED STATES PATENT AND TRADEMARK OFFICE

CERTIFICATE OF CORRECTION

PATENT NO. : 4,315,474

DATED : February 16, 1982

INVENTOR(S) : Ernst Dreier

It is certified that error appears in the above—identified patent and that said Letters Patent is hereby corrected as shown below:

On the Title Page, in the heading of the patent, under the category "[73] Assignee:" change "Fritz Gerauf Aktiengesellschaft Bernina-Nahmaschinenfabrik"

to -- Fritz Gegauf Aktiengesellschaft Bernina-Nähmaschinenfabrik --

Signed and Sealed this

*Twelfth* Day of *October 1982*

[SEAL]

*Attest:*

GERALD J. MOSSINGHOFF

*Attesting Officer*

*Commissioner of Patents and Trademarks*